US010173337B2

(12) United States Patent
Yamada et al.

(10) Patent No.: US 10,173,337 B2
(45) Date of Patent: Jan. 8, 2019

(54) SHEET CUTTING DEVICE

(71) Applicants: Hiroyuki Yamada, Yamanashi-ken (JP); Takuma Kobayashi, Yamanashi-ken (JP)

(72) Inventors: Hiroyuki Yamada, Yamanashi-ken (JP); Takuma Kobayashi, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 168 days.

(21) Appl. No.: 14/336,314

(22) Filed: Jul. 21, 2014

(65) Prior Publication Data

US 2015/0020662 A1 Jan. 22, 2015

(30) Foreign Application Priority Data

Jul. 22, 2013 (JP) ..... 2013-152078
Jul. 22, 2013 (JP) ..... 2013-152079

(51) Int. Cl.
*B26D 7/18* (2006.01)
*B26D 1/08* (2006.01)
(Continued)

(52) U.S. Cl.
CPC ..... *B26D 7/18* (2013.01); *B26D 1/08* (2013.01); *B26D 1/085* (2013.01); *B26D 7/1818* (2013.01);
(Continued)

(58) Field of Classification Search
CPC .. B26D 1/08; B26D 1/085; B26D 2007/0018; B26D 2007/322; B26D 7/18;
(Continued)

(56) References Cited

U.S. PATENT DOCUMENTS 3,841,183 A * 10/1974 Van Zyl ..... B23D 33/025 83/157
4,246,816 A * 1/1981 Ivanoff ..... B23D 33/025 83/157
(Continued)

FOREIGN PATENT DOCUMENTS

JP S56-137915 U 10/1981
JP 2002-120967 A 4/2002
(Continued)

OTHER PUBLICATIONS

Machine translation of JP 2010-247237A, Nov. 2010.*

*Primary Examiner* — Stephen Choi
(74) *Attorney, Agent, or Firm* — Manabu Kanesaka

(57) ABSTRACT

A sheet cutting device includes a stage including a placement surface on which a to-be-cut sheet is placed; a strip-shaped fixed blade that is provided in one end portion of the stage; a movable blade that works together with the fixed blade to cut the sheet placed on the placement surface of the stage gradually from one end portion of the sheet to a different one end portion; and a support section that is located between the one end of the fixed blade and the other end in such a way as to be closer to a vertically downward side than the fixed blade and be closer to a vertically upward side than a bottom surface of a waste box placed closer to the vertically downward side than the fixed blade, to temporarily support part of a remnant generated after cutting by the fixed and movable blades.

19 Claims, 16 Drawing Sheets

(51) Int. Cl.
*B26D 7/32* (2006.01)
*B26D 7/00* (2006.01)

(52) U.S. Cl.
CPC ..... *B26D 2007/0018* (2013.01); *B26D 2007/322* (2013.01); *Y10T 83/2096* (2015.04); *Y10T 83/2198* (2015.04); *Y10T 83/222* (2015.04)

(58) Field of Classification Search
CPC ..... B26D 7/1818; Y10T 83/2096; Y10T 83/2198; Y10T 83/22216; Y10T 83/2083; Y10T 83/2081; Y10T 83/222; Y10T 83/2179
See application file for complete search history.

(56) References Cited

U.S. PATENT DOCUMENTS 4,445,409 A * 5/1984 Mohr ..... B26D 7/18 83/157
7,987,751 B2 * 8/2011 Shiokawa ..... G03G 15/6523 222/527
2009/0165625 A1 * 7/2009 Ishii ..... B26D 1/08 83/613

FOREIGN PATENT DOCUMENTS

JP 2009-126690 A 6/2009
JP 2010-247237 A 11/2010

* cited by examiner

SHEET CUTTING DEVICE

BACKGROUND OF THE INVENTION

Technical Field

The present invention relates to a sheet cutting device that cuts a sheet.

Description of the Related Art

Conventionally, for the purpose of bookbinding or the like, a sheet cutting device that cuts a sheet has been used (e.g., Japanese Patent Application Laid-Open Publication No. 2010-247237). A conventional sheet cutting device includes a stage, on which a to-be-cut sheet is placed; a strip-shaped fixed blade, which is provided on the stage; and a movable blade, which works cooperatively with the fixed blade to cut a sheet. In the case of the conventional sheet cutting device, the to-be-cut sheet is placed on the stage, and a portion of the sheet that is protruding from the stage is supplementarily supported by an auxiliary section, and the fixed blade and the movable blade work together to cut the sheet placed on the stage. The cutting generates remnants, which fall and are stored in a waste box.

OBJECT OF THE INVENTION

As in the case of the conventional sheet cutting device, if the cutting of a sheet is conducted from one end portion of the sheet to a different one end portion (hereinafter, the "different one end portion" may be referred to as "other end portion".), a portion of the sheet that is just about to be cut is sandwiched between the fixed and movable blades of the sheet cutting device and is supported by the fixed and movable blades. The cutting generates remnants, which hang vertically downward due to gravity.

Immediately before the cutting is finished, the other end portion of the sheet is supported by the fixed and movable blades. Therefore, the remnants generated by the cutting do not move away from the sheet, and are located near a vertically downward side of the other end portion. After the cutting is finished, the remnants fall and are stored in a waste box in such a way that the remnants are accumulated near the vertically downward side of the other end portion. The length of a side of the waste box that is parallel to the fixed blade is only slightly longer than the distance from the above one end portion to the other end portion, and the waste box is shallow. That is, the waste box is small.

Accordingly, some of the remnants come out of the waste box at around the vertically downward side of the other end portion. The remnants coming out of the waste box may move onto a to-be-cut sheet during a subsequent cutting process, or may be sandwiched between two adjacent sheets when a plurality of sheets stacked are to be cut. In this manner, the remnants could cause trouble in the cutting process or in the subsequent processes, such as processing of the sheets. Moreover, as described above, the remnants are stored in a waste box in such a way that the remnants are accumulated near the vertically downward side of the other end portion. Therefore, compared with the case where the remnants are stored evenly in the waste box, the remnants stored in the waste box need to be collected many times. It is hoped that a sheet cutting device that can store remnants generated by cutting in a waste box in such a way as to reduce an uneven distribution of the remnants even when a sheet is cut gradually from one end portion of the sheet to the other end portion will be provided.

The object of the present invention is to provide a sheet cutting device that can store remnants generated by cutting in a waste box in such a way as to reduce an uneven distribution of the remnants even when a sheet is cut gradually from one end portion of the sheet to a different one end portion.

BRIEF SUMMARY OF THE INVENTION

According to one aspect of the present invention, a sheet cutting device includes: a stage that includes a placement surface on which a to-be-cut sheet is placed; a strip-shaped fixed blade that is provided in one end portion of the stage; a movable blade that approaches the fixed blade gradually from one end of the fixed blade to the other end, and works together with the fixed blade to cut the sheet placed on the placement surface of the stage gradually from one end portion of the sheet to a different one end portion; and a support section. The support section is located between the one end of the fixed blade and the other end in such a way as to be closer to a vertically downward side than the fixed blade, when the placement surface of the stage that is in a horizontal state faces a vertically upward side, and be closer to the vertically upward side than a bottom surface of a waste box placed closer to the vertically downward side than the fixed blade and in such a way as to protrude toward an outer side of the stage from a plane that is part of an outer surface different from the placement surface of the stage and contains the one end of the fixed blade and the other end, to temporarily support part of a remnant generated after cutting by the fixed and movable blades.

A side portion of the support section that is closer to the one end of the fixed blade may be perpendicular to the above plane; or at least one portion of a side portion of the support section that is closer to the one end of the fixed blade may be inclined toward a plane that is perpendicular to the above plane and to the placement surface of the stage and contains the one end of the fixed blade.

A side portion of the support section that is closer to the other end of the fixed blade may be perpendicular to the above plane; or at least one portion of a side portion of the support section that is closer to the other end of the fixed blade may be inclined toward a plane that is perpendicular to the above plane and to the placement surface of the stage and contains the one end of the fixed blade.

The support section is made of film, and the support section may have a function of changing posture from a horizontal state to a vertically downward side when the placement surface of the stage that is in a horizontal state faces a vertically upward side, and a function of restoring the posture. In this case, the support section is in a comb-like shape, and a plurality of teeth of the support section may be arranged in such a way as not to overlap in a vertical direction when the placement surface of the stage that is in a horizontal state faces a vertically upward side.

The sheet cutting device further includes a holding section to which a support section is attached. The support section includes a plate-like member and an attaching section. The attaching section includes a hinge and a spring. The plate-like member may be attached to the holding section through the attaching section in such a way that the plate-like member is placed horizontally when the placement surface of the stage that is in a horizontal state faces a vertically upward side.

An upper surface of the support section may be inclined vertically downward when the placement surface of the stage that is in a horizontal state faces a vertically upward side.

DETAILED DESCRIPTION OF THE INVENTION

Figure 1:
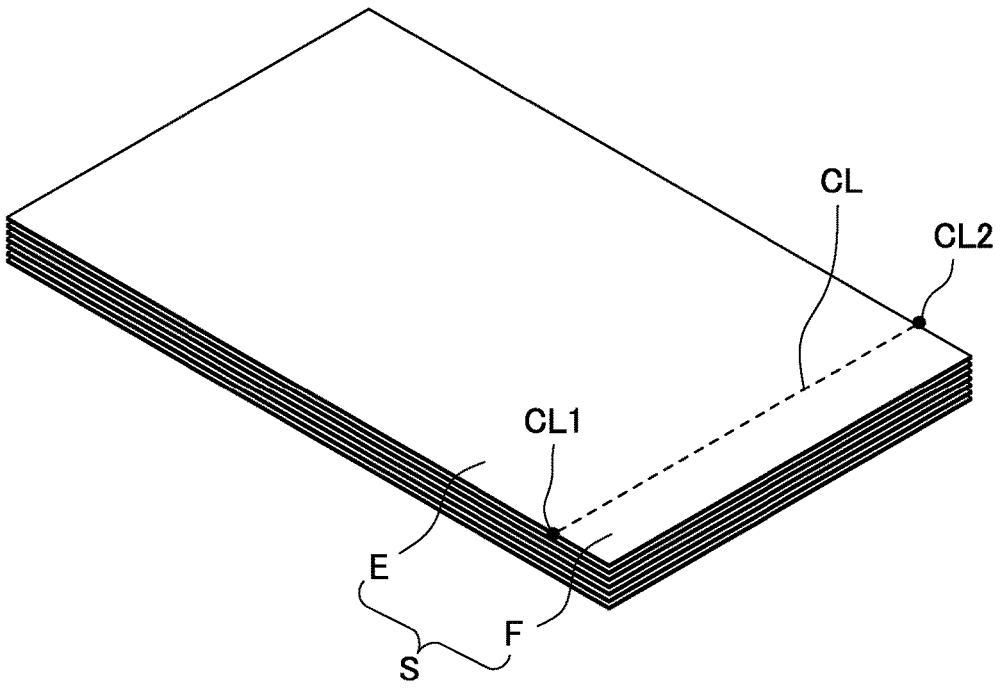
FIG. 1 is a perspective view of sheets to be cut by a sheet cutting device according to an embodiment of the present invention.

A sheet cutting device of an embodiment of the present invention will be described with reference to the accompanying drawings. Before an explanation of the configuration of the sheet cutting device of the present embodiment is given, an operation of the sheet cutting device of the present embodiment will be briefly described. FIG. 1 is a perspective view of sheets S to be cut by the sheet cutting device according to the embodiment of the present invention. In many cases, the sheets S are paper, and the sheet cutting device of the present embodiment cut a plurality of sheets S stacked. FIG. 1 shows a plurality of sheets S stacked.

A region of the sheets S that is to be cut by the sheet cutting device is a cutting line CL indicated by broken line. The cutting line CL is a straight line. The sheet cutting device of the present embodiment starts to cut the sheets S from one end portion CL1 of the cutting line CL, which is one end portion of the sheets S, toward the other end portion CL2 of the cutting line CL, which is a different one end portion of the sheets S. Of two regions of the sheets S separated by the cutting line CL, a larger region E is an area that is effectively used for bookbinding or the like after the cutting by the sheet cutting device. Of the two regions separated by the cutting line CL, a smaller region F is an area that turns out to be remnants after the cutting by the sheet cutting device.

Figure 2:
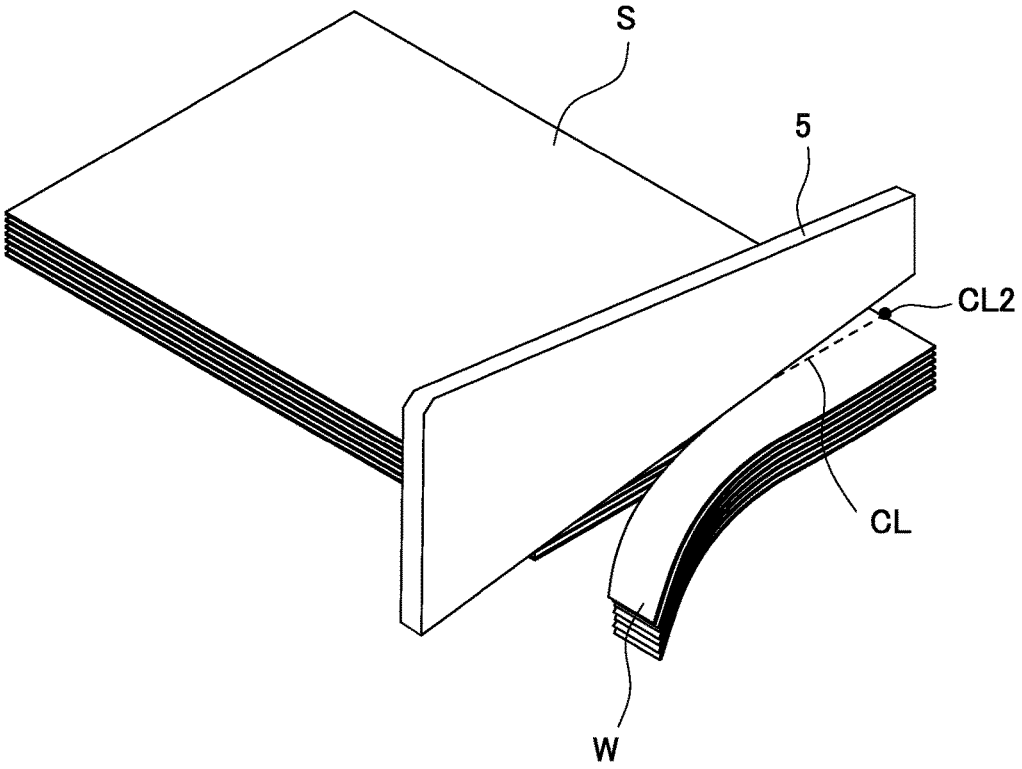
FIG. 2 is a diagram schematically showing to-be-cut sheets cut by a sheet cutting device according to an embodiment of the present invention.

FIG. 2 is a diagram schematically showing to-be-cut sheets S cut by the sheet cutting device according to the embodiment of the present invention. As described later, the sheet cutting device of the present embodiment includes a movable blade 5. In order to briefly explain a cutting operation, FIG. 2 only shows the movable blade 5 and the sheets S. FIG. 2 does not show the one end portion CL1 of the cutting line CL. However, as described above with reference to FIG. 1, the sheet cutting device of the present embodiment starts to cut the sheets S from the one end portion CL1 of the cutting line CL toward the other end portion CL2. Therefore, as shown in FIG. 2, strip-shaped remnants W are generated. The remnants W fall and are stored in a waste box 7, which will be described later.

Figure 3:
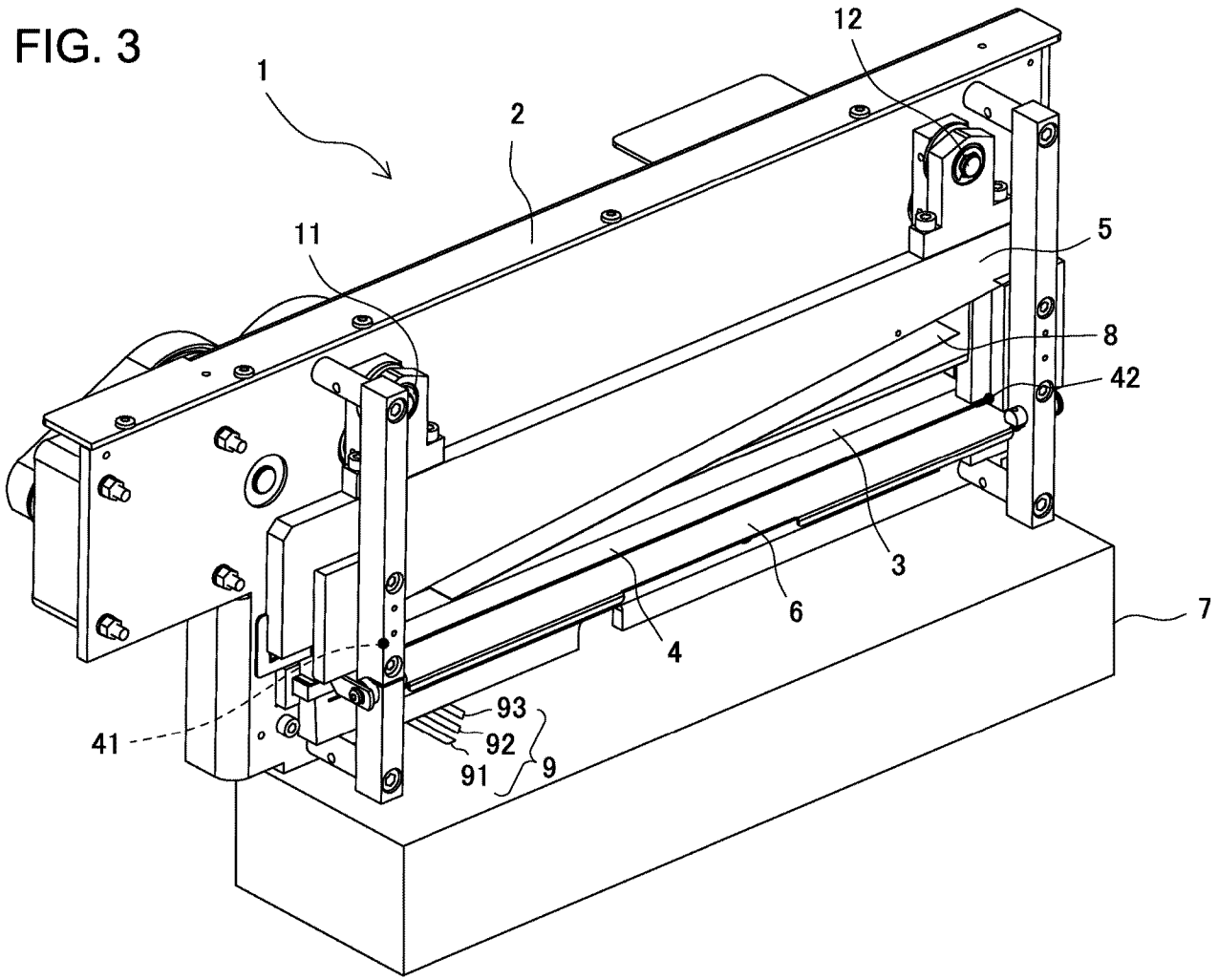
FIG. 3 is a perspective view of a sheet cutting device according to an embodiment of the present invention.
Figure 4:
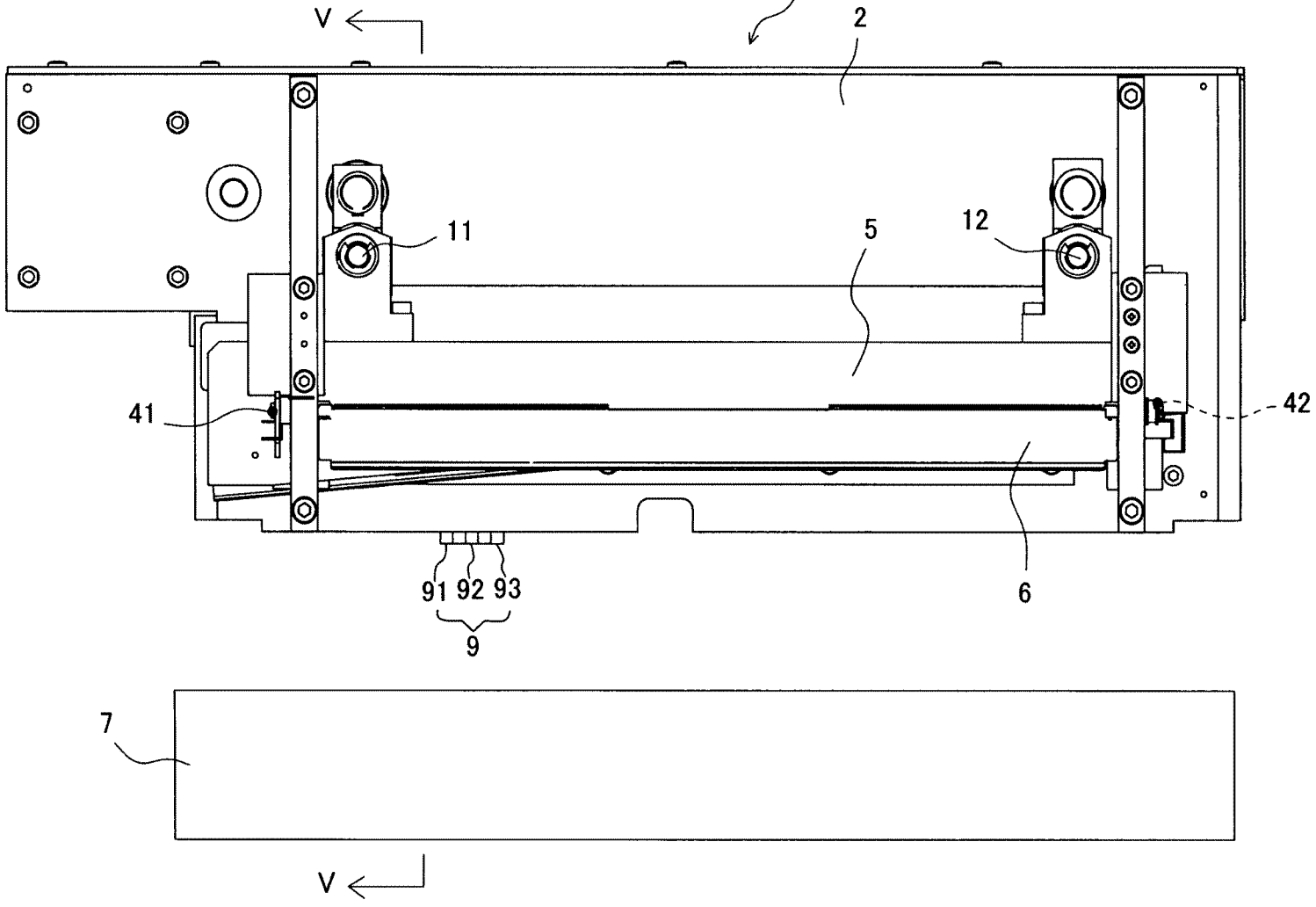
FIG. 4 is a front view of the sheet cutting device shown in FIG. 3.
Figure 5:
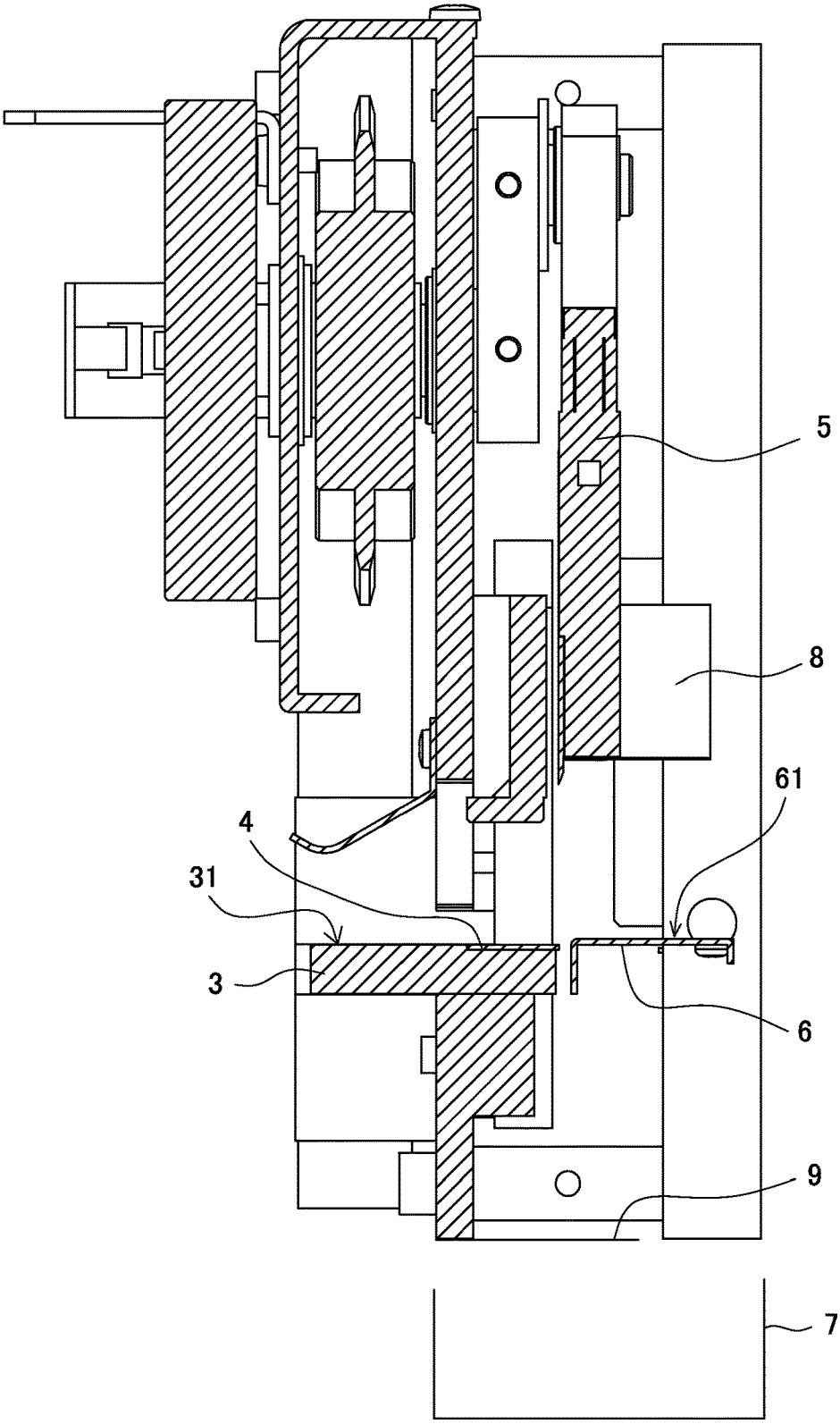
FIG. 5 is a cross-sectional view of the sheet cutting device taken along line V-V shown in FIG. 4.

The configuration of the sheet cutting device of the embodiment of the present invention will be described. FIG. 3 is a perspective view of a sheet cutting device 1 according to the embodiment of the present invention. FIG. 4 is a front view of the sheet cutting device 1 shown in FIG. 3. FIG. 5 is a cross-sectional view of the sheet cutting device 1 taken along line V-V shown in FIG. 4. The sheet cutting device 1 is a device that comes after an image formation device, and is aimed at bookbinding or the like. The sheet cutting device 1 therefore cuts sheets S processed by the image formation device. The image formation device is not shown in the diagrams.

As shown in FIGS. 3, 4, and 5, the sheet cutting device 1 includes a frame 2, a stage 3, a fixed blade 4, the movable blade 5, a guide plate 6, a waste box 7, a scraping-off section 8, and a support section 9. On the frame 2, the stage 3 and the movable blade 5 are mounted. On the stage 3, a to-be-cut sheet S is placed. The stage 3 includes a placement surface 31. The to-be-cut sheet S is guided by the guide plate 6 and is transferred from the image formation device to the stage 3, and the to-be-cut sheet S is placed on the placement surface 31 of the stage 3. In many cases, a plurality of sheets S are placed on the placement surface 31 of the stage 3.

The fixed blade 4 is a strip-shaped blade that is provided in one end portion of the stage 3. As described above, the sheet cutting device 1 is a device that comes after the image formation device. The fixed blade 4 is provided in an end portion that is closest to the image formation device, among the end portions of the stage 3. The movable blade 5 is a plate-like blade that works together with the fixed blade 4 to cut the sheets S placed on the placement surface 31 of the stage 3. The movable blade 5 is mounted on the frame 2 through a first rotation member 11 and a second rotation member 12.

The frame 2 has a chain on a back surface thereof: the chain is used to rotate the first rotation member 11 and the second rotation member 12 in synchronization. The frame 2 also has a motor to rotate the chain. As the chain is rotated by the motor, the first rotation member 11 and the second rotation member 12 rotate in synchronization. As a result, the plate-like movable blade 5 is rotated on one plane.

More specifically, when the placement surface 31 of the stage 3 that is in a horizontal state faces a vertically upward side, as shown in FIG. 2, the plate-like movable blade 5 is rotated on one vertical plane. At this time, the movable blade 5 gradually approaches the fixed blade 4 from one end 41 of the fixed blade 4 toward the other end 42. The movable blade 5 works cooperatively with the fixed blade 4 to cut the sheets S placed on the placement surface 31 of the stage 3 from one end portion of the sheets S toward a different one end portion. More specifically, when the placement surface 31 of the stage 3 that is in a horizontal state faces a vertically upward side, the movable blade 5 cuts the sheets S as the movable blade 5 approaches the fixed blade 4 in such a way as to move from the vertically upward side to a vertically downward side. Incidentally, the one end 41 of the fixed blade 4 is not clearly shown in FIGS. 3, 4, and 5. However, as described above, the fixed blade 4 is a strip-shaped blade provided in one end portion of the stage 3, and the other end 42 of the fixed blade 4 is clearly shown in FIGS. 3 and 4. Therefore, the one end 41 of the fixed blade 4 can be easily understood. The plate-like movable blade 5 is a trapezoidal blade that becomes larger in width toward the one end 41 of the fixed blade 4 and becomes smaller in width toward the other end 42 of the fixed blade 4.

The guide plate 6 is designed to guide a to-be-cut sheet S to the placement surface 31 of the stage 3. As described above, the sheet cutting device 1 comes after the image formation device. In order to cut the sheets S processed by the image formation device for the purpose of bookbinding or the like, the guide plate 6 guides the sheets S processed by the image formation device to the placement surface 31 of the stage 3. The guide plate 6 also functions as an auxiliary section to supplementarily support portions of the to-be-cut sheets S protruding from the stage 3 after the sheets S are placed on the placement surface 31 of the stage 3.

A surface (referred to as a "guide surface", hereinafter) 61 of the guide plate 6, which guides a to-be-cut sheet S to the placement surface 31 of the stage 3, is positioned within a plane containing the placement surface 31 when the sheet S is guided to the placement surface 31 of the stage 3. When the sheet S is cut by the fixed blade 4 and the movable blade 5, as described above, the movable blade 5 moves from the vertically upward side to the vertically downward side to cut the sheet S. Therefore, when the sheet S is to be cut, the guide surface 61 collapses vertically downward as the movable blade 5 moves, thereby preventing the guide surface 61 from colliding with the movable blade 5.

When the placement surface 31 of the stage 3 that is in a horizontal state faces the vertically upward side, the waste box 7 is placed at a position that is closer to the vertically downward side than the fixed blade 4. More specifically, in the above-described case, the waste box 7 is placed on a vertically downward side of the guide plate 6. The waste box 7 is a box that is in the shape of a rectangular parallelepiped; strip-shaped remnants W of the sheets S falling after the cutting by the fixed blade 4 and the movable blade 5 are stored in the box. In the above-described case, the waste box 7 has an opening that is located on a vertically upward side. The remnants W are stored inside the waste box 7 through the opening. The length of a side of the waste box 7 that is parallel to the fixed blade 4 is only slightly longer than the length of the cutting line CL on the sheets S. For example, the depth of the waste box 7 is about one-third of the cutting line CL and is therefore shallow. That is, the waste box 7 is small.

The scraping-off section 8 is provided in such a way as to protrude from a plane of the movable blade 5 containing a plane of a side that does not come in contact with the fixed blade 4 toward an outer side of the stage 3. The scraping-off section 8 operates as the movable blade 5 moves. The direction toward the outer side of the stage 3 is a direction from an inner side of the stage 3 to the outer side. More specifically, the scraping-off section 8 is in the shape of a plate. The scraping-off section 8 is fixed on the movable blade 5 in such a way as to be kept perpendicular to the movable blade 5.

More specifically, the scraping-off section 8 is a brush made of conductive material. When the placement surface 31 of the stage 3 that is in a horizontal state faces the vertically upward side, the scraping-off section 8 moves from the vertically upward side to the vertically downward side to scrape off strip-shaped remnants W of the sheets S, which adhere to the guide surface 61 of the guide plate 6 after being generated by cutting by the fixed blade 4 and the movable blade 5. Incidentally, the scraping-off section 8 is placed at a position where the scraping-off section 8 is not in contact with the sheets S, when the guide plate 6 guides to-be-cut sheets S to the placement surface 31 of the stage 3.

When the placement surface 31 of the stage 3 that is in a horizontal state faces the vertically upward side, the support section 9, between the one end 41 of the fixed blade 4 and the other end 42, is located at a position that is closer to the vertically downward side than the fixed blade 4 and closer to the vertically upward side than the top of the waste box 7 placed closer to the vertically downward side than the fixed blade 4. More specifically, when the placement surface 31 of the stage 3 that is in a horizontal state faces the vertically upward side, the support section 9 is provided in a region that is part of a bottom surface of the frame 2. The bottom surface of the frame 2 is located closer to the vertically upward side than the top of the waste box 7. Moreover, the support section 9 is provided in such a way as to protrude toward the outer side of the stage 3 from a plane that is part of an outer surface different from the placement surface 31 of the stage 3 and contains the one end 41 of the fixed blade 4 and the other end 42. Protruding toward the outer side of the stage 3 means protruding from the inner side of the stage 3 toward the outer side.

Figure 6:
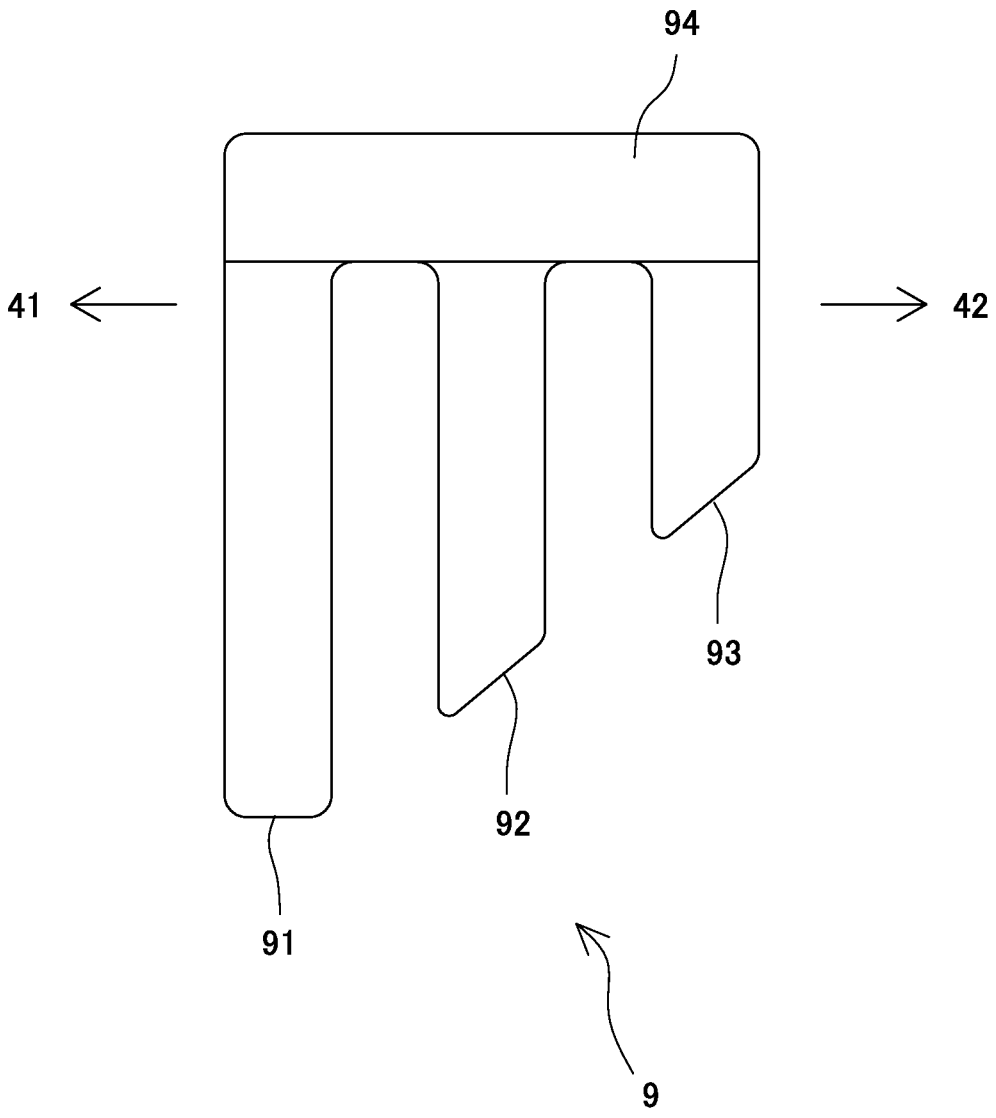
FIG. 6 is a plane view of a support section of the sheet cutting device shown in FIG. 3.

FIG. 6 is a plane view of the support section 9 of the sheet cutting device 1 shown in FIG. 3. The support section 9 is made of film. For example, the support section 9 is made of polyester. The support section 9 is in a comb-like shape. As shown in FIGS. 3, 4, and 6, the support section 9 includes a plurality of teeth 91, 92, and 93. A plurality of teeth 91, 92, and 93 are provided in such a way as to protrude toward the outer side of the stage 3 from a plane that is part of an outer surface different from the placement surface 31 of the stage 3 and contains the one end 41 of the fixed blade 4 and the other end 42. Moreover, when the placement surface 31 of the stage 3 that is in a horizontal state faces a vertically upward side, a plurality of teeth 91, 92, and 93 are so provided as not to overlap in the vertical direction. What is shown in FIG. 6 is the support section 9 in this case, which is viewed in a direction from the vertically upward side to the vertically downward side. That is, FIG. 6 is a top view of the support section 9.

Furthermore, when the placement surface 31 of the stage 3 that is in a horizontal state faces a vertically upward side, a plurality of teeth 91, 92, and 93 have a function of changing posture from a horizontal state to the vertically downward side, and a function of restoring the posture. The support section 9 includes a fixed section 94. A plurality of teeth 91, 92, and 93 are so provided as to protrude from the fixed section 94. The fixed section 94 is bonded to the bottom surface of the frame 2. For example, the fixed section 94 is bonded to the bottom surface of the frame 2 with an adhesive. The fixed section 94 is bonded to the bottom surface of the frame 2, and the support section 9 is therefore mounted on the frame 2. Incidentally, the fixed section 94 may be attached to the bottom surface of the frame 2 with screws or the like.

As shown in FIGS. 4 and 6, a side portion of the support section 9 that is closer to the one end 41 of the fixed blade 4, i.e., the tooth 91 of the support section 9, is perpendicular to a plane that is part of an outer surface different from the placement surface 31 of the stage 3 and contains the one end 41 of the fixed blade 4 and the other end 42. A side portion of the support section 9 that is closer to the other end 42 of the fixed blade 4, i.e., the tooth 93 of the support section 9, is perpendicular to the above-described plane, too. As described above with reference to FIG. 2, the cutting by the fixed blade 4 and the movable blade 5 generates strip-shaped remnants W, which then fall. The support section 9 temporarily supports some of the falling strip-shaped remnants W.

Figure 7:
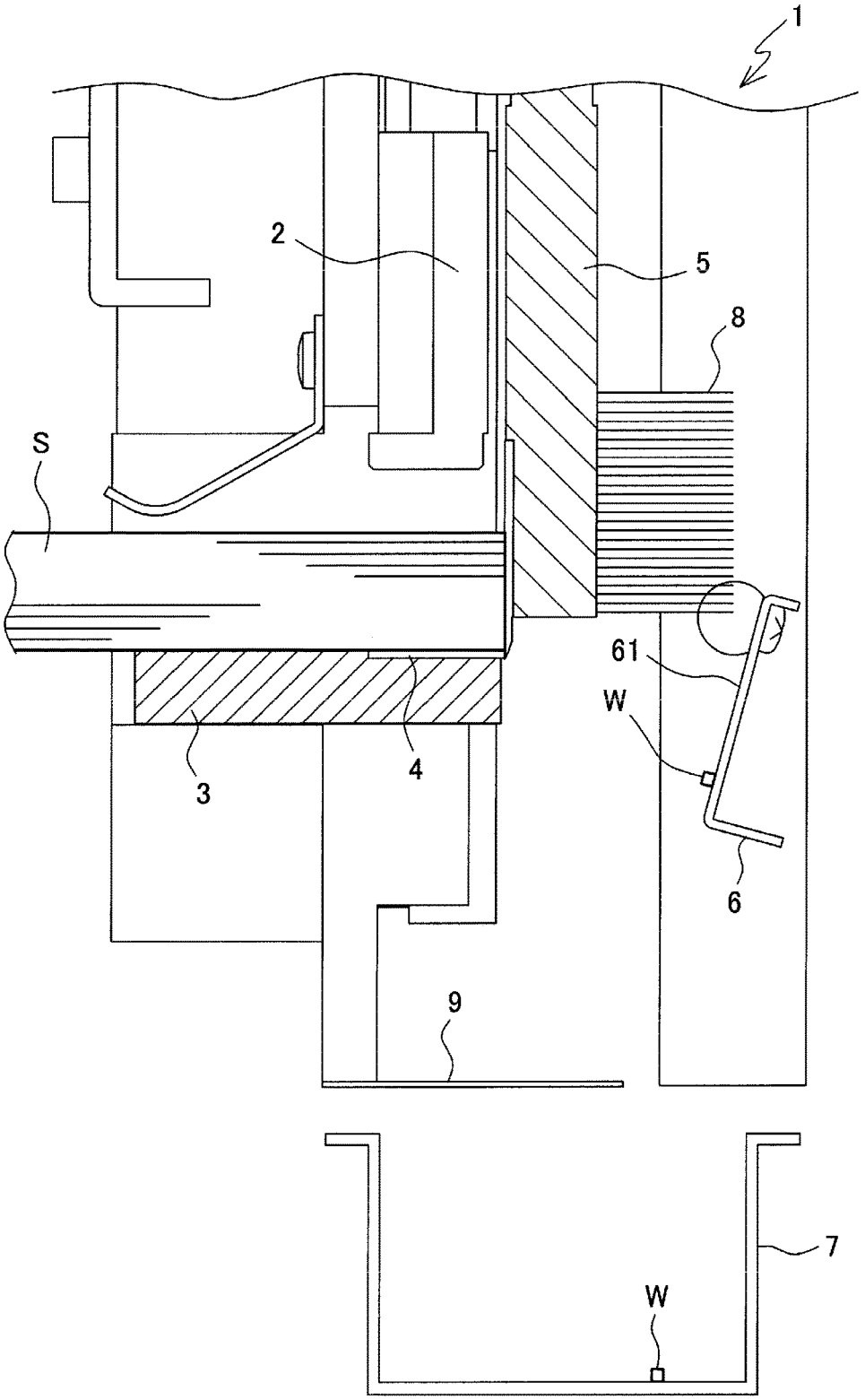
FIG. 7 is a diagram showing remnants adhering to a guide surface of a guide plate of the sheet cutting device after to-be-cut sheets are cut by the sheet cutting device of the embodiment of the present invention.

The following describes how the remnants W generated by the cutting of sheets S will fall before being stored in the waste box 7, and other situations. As described above with reference to FIGS. 1 and 2, the sheet cutting device 1 cuts a plurality of sheets S stacked gradually from the one end portion CL1 of the cutting line CL toward the other end portion CL2. As a result, strip-shaped remnants W are generated. The remnants W may adhere to the guide surface 61 of the guide plate 6 due to static electricity or the like. FIG. 7 is a diagram showing remnants W adhering to the guide surface 61 of the guide plate 6 of the sheet cutting device 1 after to-be-cut sheets S are cut by the sheet cutting device 1 of the embodiment of the present invention.

More specifically, FIG. 7 shows a situation where the guide surface 61 of the guide plate 6 is about to collapse vertically downward as the movable blade 5 moves from the vertically upward side to the vertically downward side when the sheets S are cut. The sheet cutting device 1 of the present embodiment includes the scraping-off section 8. As described above, the scraping-off section 8 is provided on the movable blade 5. During the cutting process of the sheets S, the movable blade 5 moves from the vertically upward side to the vertically downward side. Accordingly, the scraping-off section 8, too, moves from the vertically upward side to the vertically downward side.

Figure 8:
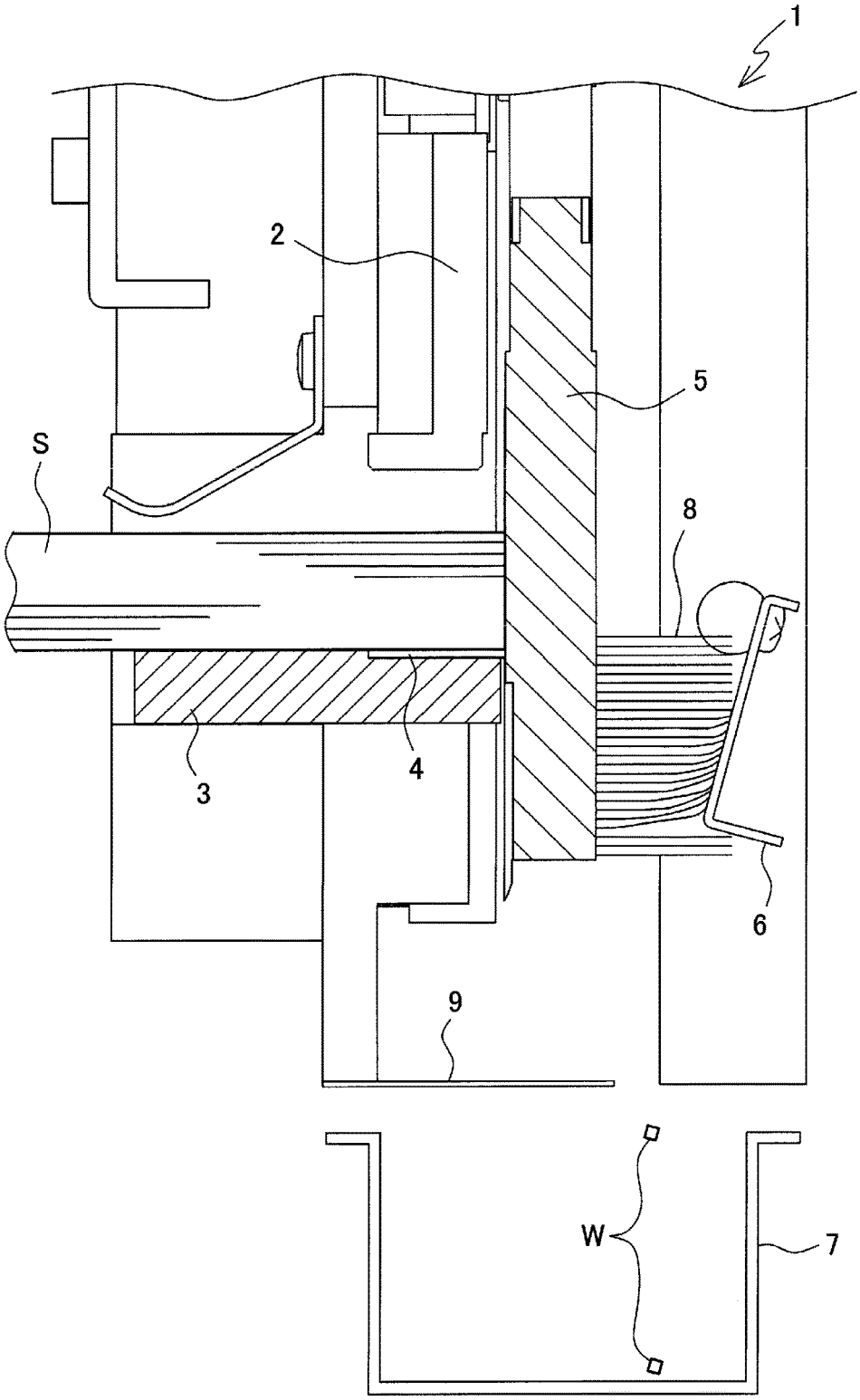
FIG. 8 is a diagram illustrating a situation where remnants adhering to the guide surface of the guide plate are scraped off by a scraping-off section of the sheet cutting device of the present embodiment.

During the cutting process of the sheets S, the scraping-off section 8 moves from the vertically upward side to the vertically downward side, thereby scraping off the remnants W adhering to the guide surface 61 of the guide plate 6 as shown in FIG. 8. FIG. 8 is a diagram illustrating a situation where the remnants W adhering to the guide surface 61 of the guide plate 6 are scraped off by the scraping-off section 8 of the sheet cutting device 1 of the present embodiment. That is, as shown in FIG. 8, by using the sheet cutting device 1 of the present embodiment, it is possible to remove the remnants W adhering to the guide plate 6.

As described above, the scraping-off section 8 is made of conductive material. Therefore, the scraping-off section 8 can remove electricity from the electrically charged remnants W. Thus, the scraping-off section 8 can more easily scrape off the remnants W adhering to the guide surface 61. Moreover, the scraping-off section 8 is a brush, and therefore is able to rub off the remnants W adhering to the guide surface 61. Therefore, the scraping-off section 8 can more easily scrape off the remnants W adhering to the guide surface 61. Incidentally, the scraping-off section 8 is provided at a position where the scraping-off section 8 does not come in contact with the sheets S when the guide plate 6 guides the to-be-cut sheets S to the placement surface 31 of the stage 3, thereby reducing the possibility that the to-be-cut sheets S are damaged by the scraping-off section 8.

The following describes how the remnants W generated by cutting of the sheets S fall and are stored in the waste box 7. As described above with reference to FIGS. 1 and 2, the cutting by the sheet cutting device 1 generates strip-shaped remnants W. A conventional sheet cutting device is different from the sheet cutting device 1 of the present embodiment in that the conventional sheet cutting device does not have the support section 9, which the sheet cutting device 1 of the present embodiment has. However, as in the case of the sheet cutting device 1 of the present embodiment, the conventional sheet cutting device cuts sheets S, thereby generating strip-shaped remnants W.

Figure 9A:
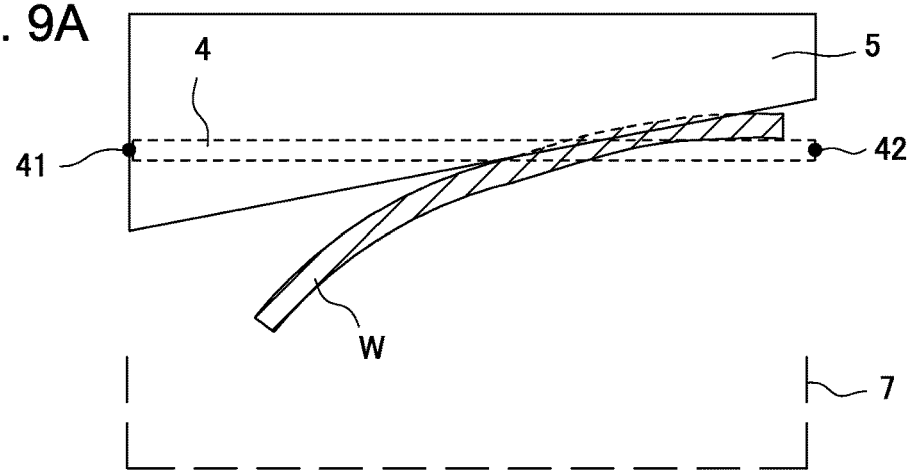
FIG. 9A is a first diagram illustrating a situation where remnants generated after cutting of sheets by a conventional sheet cutting device fall and are stored in a waste box.
Figure 9B:
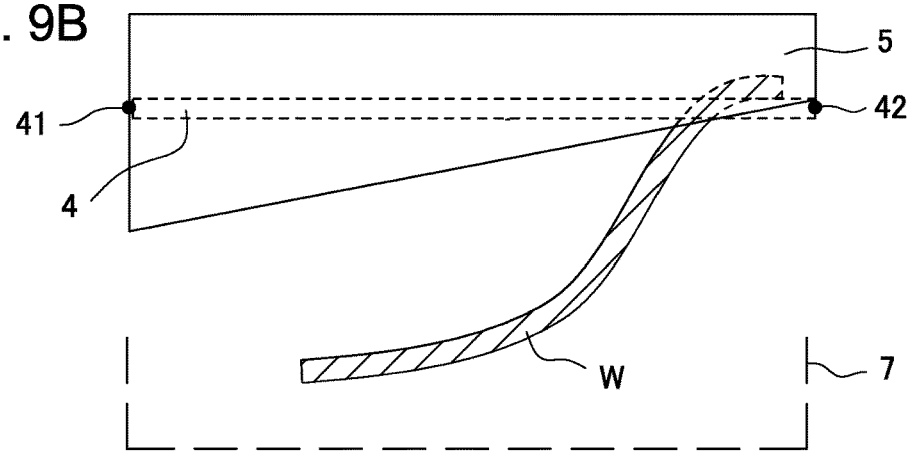
FIG. 9B is a second diagram illustrating a situation where remnants generated after cutting of sheets by a conventional sheet cutting device fall and are stored in a waste box.
Figure 9C:
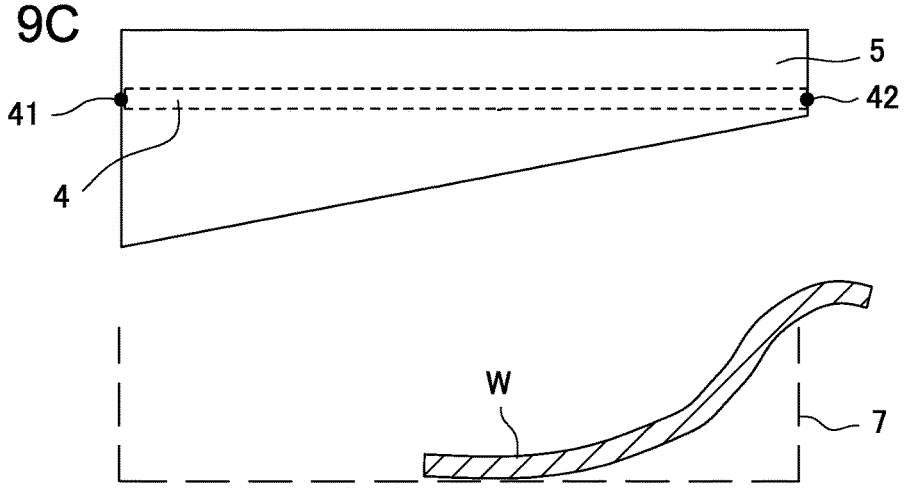
FIG. 9C is a third diagram illustrating a situation where remnants generated after cutting of sheets by a conventional sheet cutting device fall and are stored in a waste box.

With reference to FIGS. 9A, 9B, and 9C, the following describes how remnants W generated after sheets S are cut by the conventional sheet cutting device fall and are stored in the waste box 7. FIG. 9A is a first diagram illustrating a situation where remnants W generated after cutting of sheets S by the conventional sheet cutting device fall and are stored in the waste box 7. FIG. 9B is a second diagram illustrating a situation where remnants W generated after cutting of sheets S by the conventional sheet cutting device fall and are stored in the waste box 7. FIG. 9C is a third diagram illustrating a situation where remnants W generated after cutting of sheets S by the conventional sheet cutting device fall and are stored in the waste box 7.

FIG. 9A shows an initial state of the cutting process of the sheets S. FIG. 9B shows a situation where the cutting process is about to be finished. FIG. 9C shows a situation where the cutting process is finished. FIGS. 9A, 9B, and 9C show a front side of the conventional sheet cutting device. For ease of explanation, FIGS. 9A, 9B, and 9C only shows the fixed blade 4, the movable blade 5, the waste box 7, and the remnants W. In order to show the inside of the waste box 7, the waste box 7 is indicated by broken line. The remnants W generated by the cutting, as well as portions of the sheets S that are turned into remnants W due to the cutting, are indicated by hatched line. Incidentally, in FIGS. 9A, 9B, and 9C, the movement of the movable blade 5 is exaggerated to make the cutting process easier to understand.

As shown in FIGS. 9A and 9B, a portion of a sheet S that is just about to be cut is sandwiched between the fixed and movable blades 4 and 5 and is supported by the fixed and movable blades 4 and 5. The cutting generates a remnant W, which hangs vertically downward due to gravity. Immediately before the cutting is finished, as shown in FIG. 9B, the other end portion CL2 of the cutting line CL of the sheet S is supported by the fixed and movable blades 4 and 5. Therefore, the remnant W generated by the cutting does not move away from the sheet S, and is located near a vertically downward side of the other end 42 of the fixed blade 4.

As shown in FIG. 9C, after the cutting is finished, the remnant W falls and is stored in the waste box 7 in such away that the remnant W is accumulated near the vertically downward side of the other end 42 of the fixed blade 4. As described above, the waste box 7 is small. A finally generated portion of the remnant W therefore comes out of the waste box 7 at around the vertically downward side of the other end 42 of the fixed blade 4.

Figure 10A:
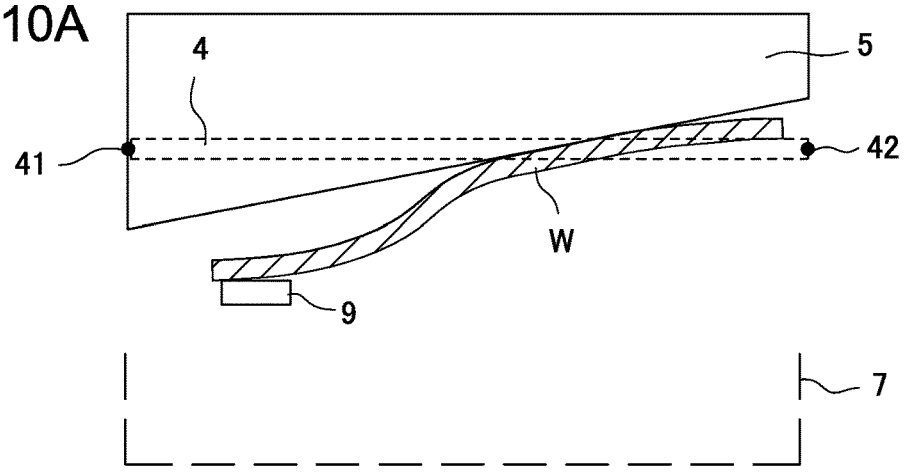
FIG. 10A is a first diagram illustrating a situation where remnants generated after cutting of sheets by the sheet cutting device of the embodiment of the present invention fall and are stored in a waste box.
Figure 10B:
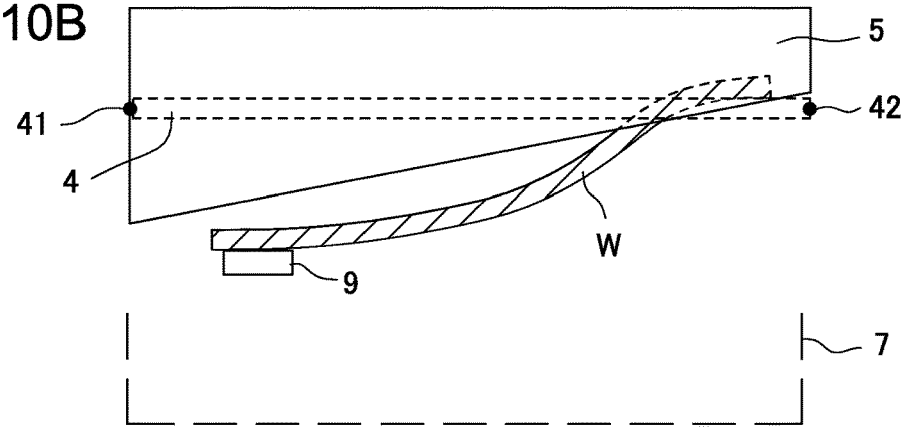
FIG. 10B is a second diagram illustrating a situation where remnants generated after cutting of sheets by the sheet cutting device of the embodiment of the present invention fall and are stored in a waste box.
Figure 10C:
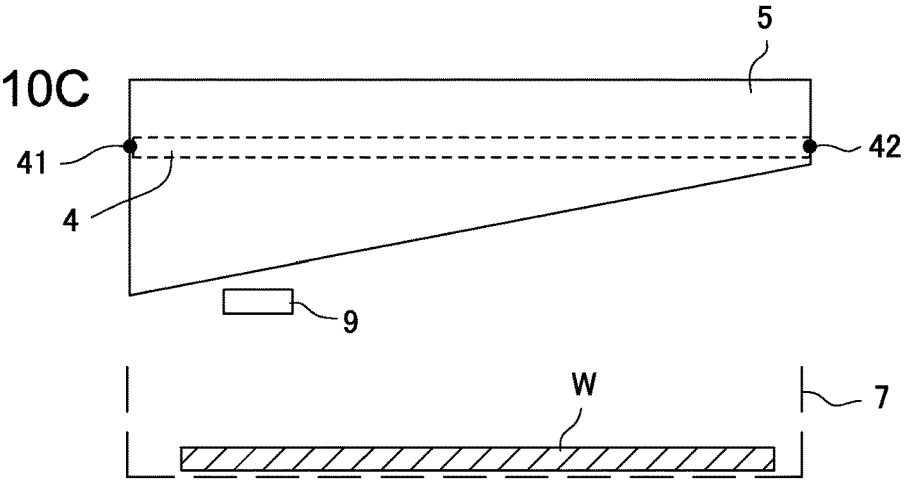
FIG. 10C is a third diagram illustrating a situation where remnants generated after cutting of sheets by the sheet cutting device of the embodiment of the present invention fall and are stored in a waste box.

The sheet cutting device 1 of the present embodiment includes the support section 9. With reference to FIGS. 10A, 10B, and 10C, the following describes how remnants W generated after sheets S are cut by the sheet cutting device 1 having the support section 9 fall and are stored in the waste box 7. FIG. 10A is a first diagram illustrating a situation where remnants W generated after cutting of sheets S by the sheet cutting device 1 of the embodiment of the present invention fall and are stored in the waste box 7. FIG. 10B is a second diagram illustrating a situation where remnants W generated after cutting of sheets S by the sheet cutting device 1 of the embodiment of the present invention fall and are stored in the waste box 7. FIG. 10C is a third diagram illustrating a situation where remnants W generated after cutting of sheets S by the sheet cutting device 1 of the embodiment of the present invention fall and are stored in the waste box 7.

FIG. 10A shows an initial state of the cutting process of the sheets S. FIG. 10B shows a situation where the cutting process is about to be finished. FIG. 10C shows a situation where the cutting process is finished. FIGS. 10A, 10B, and 10C show a front side of the sheet cutting device 1 of the present embodiment. For ease of explanation, FIGS. 10A, 10B, and 10C only shows the fixed blade 4, the movable blade 5, the waste box 7, the support section 9, and the remnants W. In order to show the inside of the waste box 7, the waste box 7 is indicated by broken line. The remnants W generated by the cutting, as well as portions of the sheets S that are turned into remnants W due to the cutting, are indicated by hatched line. Incidentally, in FIGS. 10A, 10B, and 10C, the movement of the movable blade 5 is exaggerated to make the cutting process easier to understand.

As shown in FIGS. 10A and 10B, a portion of a sheet S that is just about to be cut is sandwiched between the fixed and movable blades 4 and 5 and is supported by the fixed and movable blades 4 and 5. The cutting generates a remnant W, which hangs vertically downward due to gravity. The sheet cutting device 1 of the present embodiment has the support section 9. The support section 9, or more specifically a plurality of teeth 91, 92, and 93 of the support section 9, temporarily supports apart of the remnant W hanging after the remnant W is generated by the cutting. As shown in FIG. 10B, even when the cutting is just about to be finished, the remnant W generated by the cutting is not attracted to the vertically downward side of the other end 42 of the fixed blade 4. As a result, as shown in FIG. 10C, after the cutting is finished, the remnant W does not fall in such away as to be attracted to the vertically downward side of the other end 42 of the fixed blade 4. The remnant W is therefore stored in the waste box 7 with a smaller uneven distribution.

More specifically, as described above, a side portion of the support section 9 that is closer to the one end 41 of the fixed blade 4, i.e. the tooth 91 of the support section 9, is perpendicular to a plane that is part of an outer surface different from the placement surface 31 of the stage 3 and contains the one end 41 of the fixed blade 4 and the other end 42. This configuration raises the possibility that a part of the remnant W hanging after the remnant W is generated by the cutting is caught by a plurality of teeth 91, 92, and 93 of the support section 9. In this manner, the support section 9, or more specifically a plurality of teeth 91, 92, and 93, can easily and temporarily support a part of the remnant W hanging after the remnant W is generated by the cutting.

A side portion of the support section 9 that is closer to the other end 42 of the fixed blade 4, i.e., the tooth 93 of the support section 9, is perpendicular to a plane that is part of an outer surface different from the placement surface 31 of the stage 3 and contains the one end 41 of the fixed blade 4 and the other end 42. In this configuration, a plurality of teeth 91, 92, and 93 of the support section 9 temporarily support the remnant W hanging after the remnant W is generated by the cutting, and allow the remnant W to easily slide vertically downward after the cutting is finished and then be stored in the waste box 7.

When a plurality of teeth 91, 92, and 93 of the support section 9 temporarily support the remnant W hanging after the remnant W is generated by the cutting, the teeth 91, 92, and 93 of the support section 9 change the posture from a horizontal state to the vertically downward side due to the weight of the remnant W in the case where the placement surface 31 of the stage 3 that is in a horizontal state faces the vertically upward side. In this configuration, a plurality of teeth 91, 92, and 93 of the support section 9 temporarily support the remnant W hanging after the remnant W is generated by the cutting, and allow the remnant W to easily slide vertically downward after the cutting is finished and then be stored in the waste box 7. Incidentally, the support section 9 is made of film. When the support section 9 temporarily supports the remnant W, the support section 9 changes the posture from a horizontal state to the vertically downward side due to the weight of the remnant W. After the remnant W falls into the waste box 7, the support section 9 restores the posture. Therefore, the support section 9 can continue functioning to temporarily support the remnant W hanging after the remnant W is generated by the cutting.

As described above, the sheet cutting device 1 of the present embodiment includes the support section 9. Therefore, the sheet cutting device 1 can store remnants W generated by cutting in the waste box 7 in such away as to reduce an uneven distribution of the remnants W even when a sheet S is cut gradually from one end portion of the sheet S to a different one end portion. As a result, it is possible to keep the remnants W from coming out of the waste box, and troubles are therefore unlikely to occur in the subsequent cutting process and other processes. Moreover, the number of times the remnants stored in the waste box are collected can be reduced.

MODIFIED EXAMPLES

In the sheet cutting device 1 of the above embodiment, the scraping-off section 8 is provided on a plane of a side where the scraping-off section 8 does not come in contact with the fixed blade 4 of the movable blade 5. However, the scraping-off section 8 may not be provided on a plane of a side where the scraping-off section 8 does not come in contact with the fixed blade 4 of the movable blade 5. All that is required is for the scraping-off section 8 to be provided, on the side where the scraping-off section 8 does not come in contact with the fixed blade 4 of the movable blade 5, in such a way as to protrude toward the outer side of the stage 3 from a plane containing the plane of the side where the scraping-off section 8 does not come in contact with the fixed blade 4 of the movable blade 5, and to scrape off the remnants W adhering to the guide plate 6 by moving from the vertically upward side to the vertically downward side when the movable blade 5 moves from the vertically upward side to the vertically downward side.

The scraping-off section 8 may not be in a plate-like shape. The scraping-off section 8 may not be fixed on the movable blade 5 in such a way as to be kept perpendicular to the movable blade 5. It is preferred that the scraping-off section 8 have an electricity removal effect. However, the scraping-off section 8 may not be made of conductive material. The scraping-off section 8 may not be a brush, and may be made of cloth. The scraping-off section 8 may be attached to the movable blade 5 in such a way as to be able to swing. The scraping-off section 8 may be provided at a position where the scraping-off section 8 comes in contact with a sheet S when the guide plate 6 guides the to-be-cut sheet S to the placement surface 31 of the stage 3. In this case, if the scraping-off section 8 has an electricity removal effect, the scraping-off section 8 can remove electricity from the to-be-cut sheet S that is guided to the placement surface 31 of the stage 3, thereby reducing the possibility that the remnants W adhere to the guide plate 6.

Figure 11:
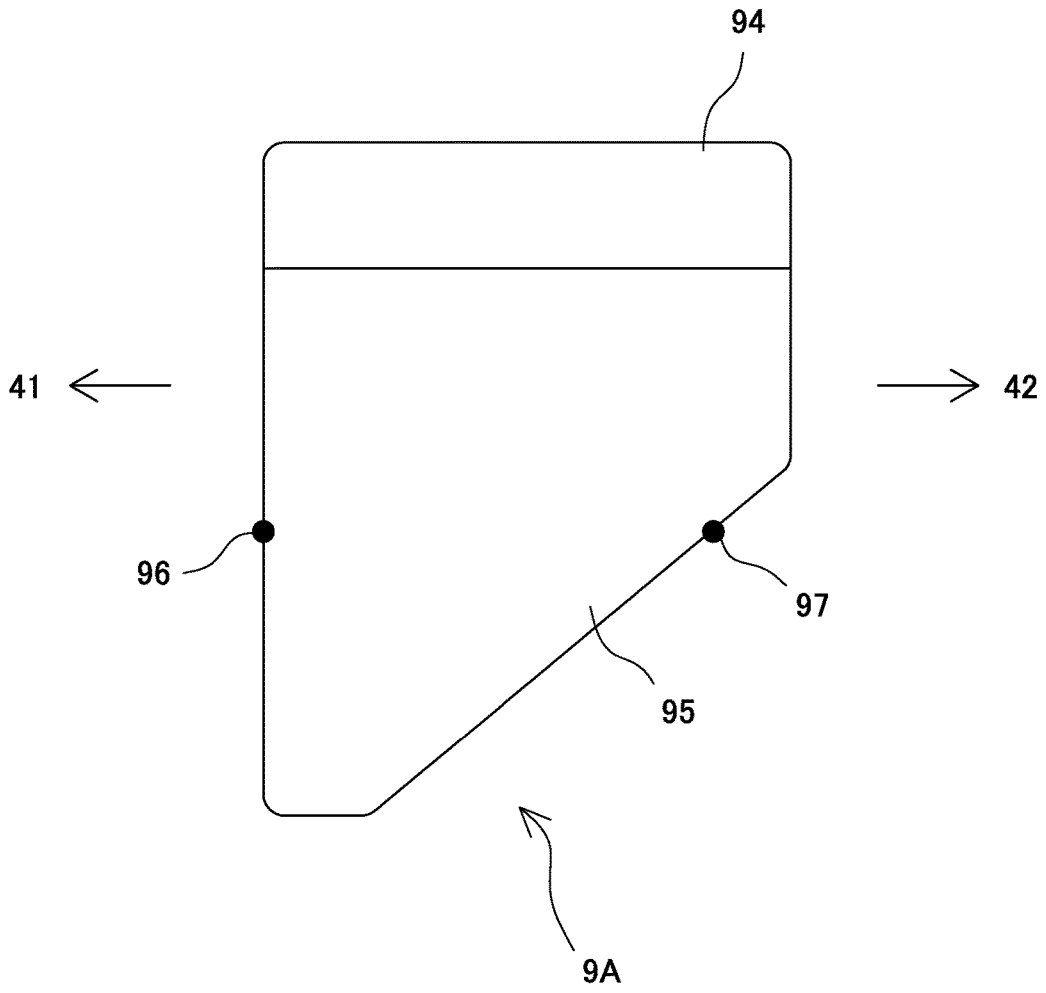
FIG. 11 is a plane view of a trapezoidal support section.

The sheet cutting device 1 of the above embodiment includes the comb-like support section 9. However, the sheet cutting device 1 may have a trapezoidal support section 9A, instead of the comb-like support section 9. FIG. 11 is a plane view of the trapezoidal support section 9A. The trapezoidal support section 9A is made of film. For example, the trapezoidal support section 9A is made of polyester.

As in the case of the teeth 91, 92, and 93 of the comb-like support section 9, the trapezoidal support section 9A includes a trapezoidal section 95 that temporarily supports a part of a remnant W hanging after the remnant W is generated by the cutting. Like the comb-like support section 9, the trapezoidal support section 9A includes a fixed section 94. The fixed section 94 is attached to the bottom surface of the frame 2 with an adhesive, screws, or the like, and the trapezoidal support section 9A is therefore mounted on the frame 2. When the placement surface 31 of the stage 3 that is in a horizontal state faces the vertically upward side, the trapezoidal support section 9A has a function of changing posture from a horizontal state to the vertically downward side, and a function of restoring the posture.

As shown in FIG. 11, a side portion 96 of the trapezoidal support section 9A that is closer to the one end 41 of the fixed blade 4 is perpendicular to a plane that is part of an outer surface different from the placement surface 31 of the stage 3 and contains the one end 41 of the fixed blade 4 and the other end 42. A portion 97 of a side portion of the trapezoidal support section 9A that is closer to the other end 42 of the fixed blade 4 is inclined toward the one end 41 of the fixed blade 4. More specifically, the portion 97 of the side portion of the trapezoidal support section 9A that is closer to the other end 42 of the fixed blade 4 is inclined toward a plane that contains the one end 41 of the fixed blade 4 and is perpendicular to the placement surface 31 of the stage 3 and to a plane that is part of an outer surface different from the placement surface 31 of the stage 3 and contains the one end 41 of the fixed blade 4 and the other end 42.

Figure 12:
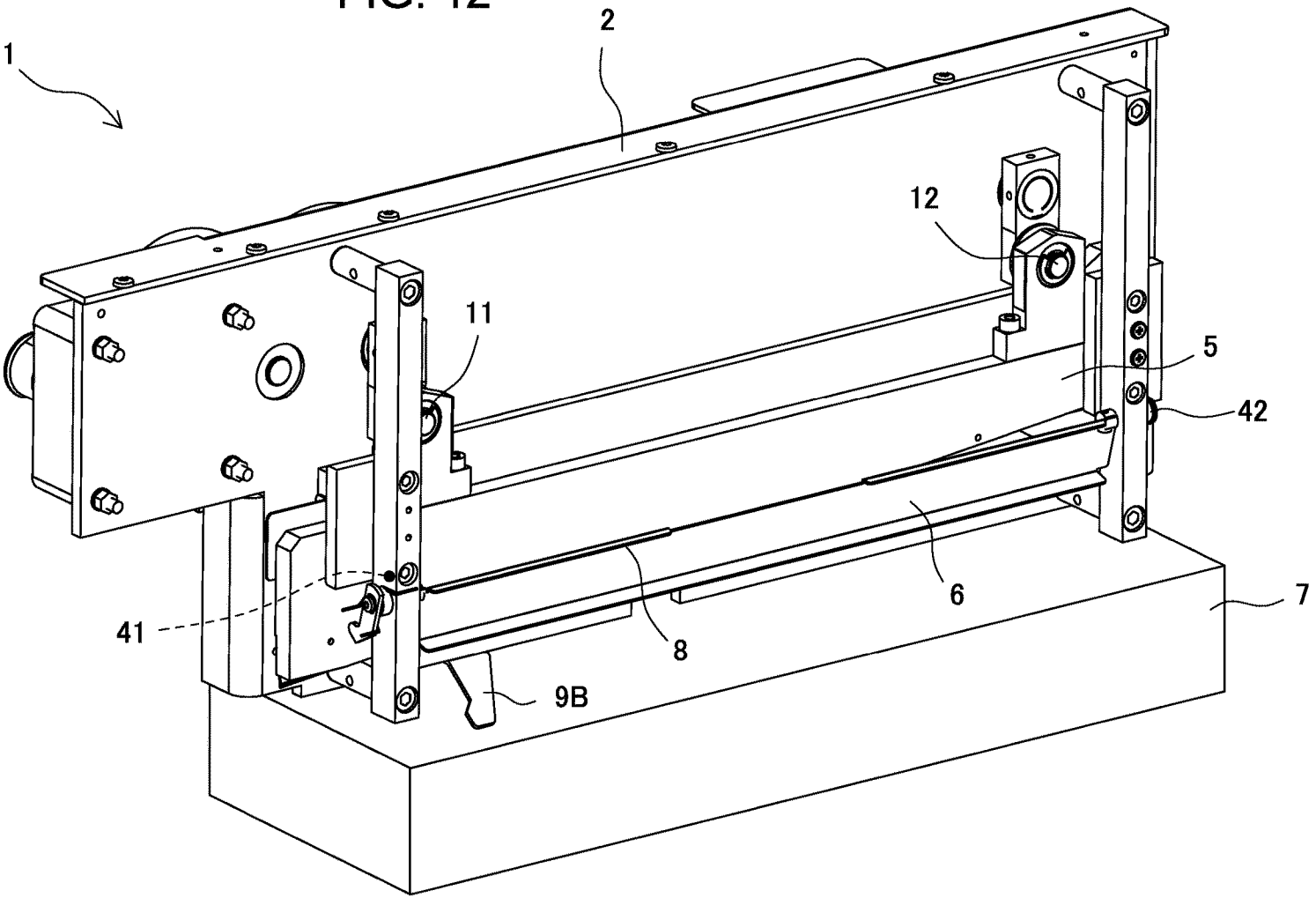
FIG. 12 is a perspective view of a sheet cutting device that includes a support section having one L-shaped portion.
Figure 13:
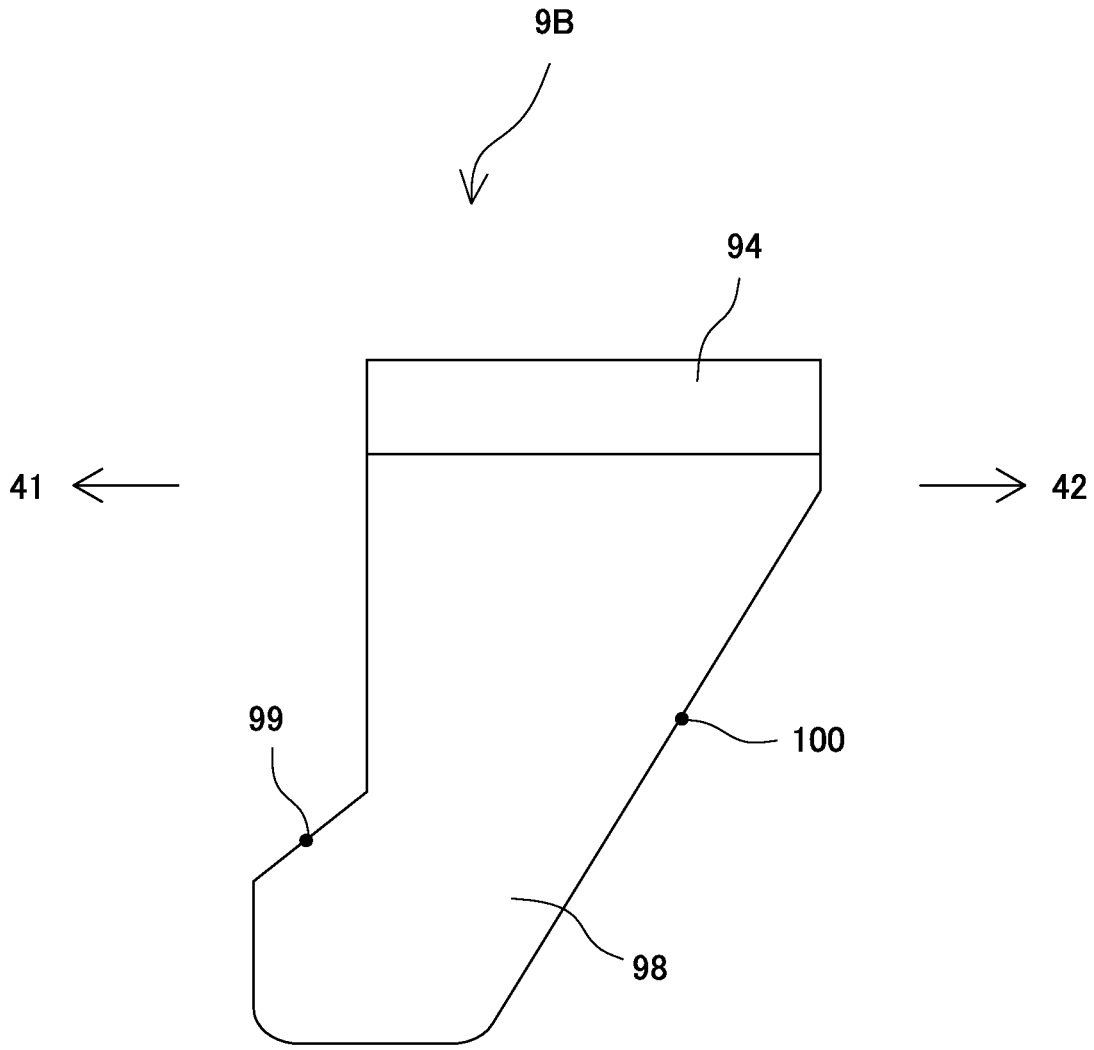
FIG. 13 is a plane view of the support section of the sheet cutting device shown in FIG. 12 that has one L-shaped portion.

Instead of the comb-like support section 9, the sheet cutting device 1 may have a support section 9B having one L-shaped portion. FIG. 12 is a perspective view of the sheet cutting device 1 that includes the support section 9B having one L-shaped portion. FIG. 13 is a plane view of the support section 9B of the sheet cutting device 1 shown in FIG. 12 that has one L-shaped portion. The support section 9B is a plate-like member, and is unlikely to deform because the support section 9B is made of resin such as ABS resin.

As in the case of the teeth 91, 92, and 93 of the comb-like support section 9, the support section 9B having one L-shaped portion includes an L-shaped section 98 that temporarily supports a part of a remnant W hanging after the remnant W is generated by the cutting. Like the comb-like support section 9, the support section 9B includes a fixed section 94. The fixed section 94 is attached to the bottom surface of the frame 2 with an adhesive, screws, or the like, and the support section 9B is therefore mounted on the frame 2. After the support section 9B is mounted on the bottom surface of the frame 2, the L-shaped section 98 of the support section 9B is inclined toward a vertically downward side from a horizontal state in the case where the placement surface 31 of the stage 3 that is in a horizontal state faces a vertically upward side. For example, the L-shaped section 98 of the support section 9B is inclined vertically downward at 45 degrees.

As shown in FIGS. 12 and 13, a portion 99 of a side portion of the L-shaped section 98 of the support section 9B that is closer to the one end 41 of the fixed blade 4 is inclined toward the one end 41 of the fixed blade 4. More specifically, the portion 99 of the side portion of the L-shaped section 98 that is closer to the one end 41 of the fixed blade 4 is bent, and is inclined toward a plane that contains the one end 41 of the fixed blade 4 and is perpendicular to the placement surface 31 of the stage 3 and to a plane that is part of an outer surface different from the placement surface 31 of the stage 3 and contains the one end 41 of the fixed blade 4 and the other end 42. A side portion 100 of the L-shaped section 98 that is closer to the other end 42 of the fixed blade 4 is inclined toward the one end 41 of the fixed blade 4. The support section 9B may be a plate-like member made of metal, or may be film made of polyester. If the frame 2 is made of metal, the support section 9B may be formed integrally with the frame 2.

Figure 14:
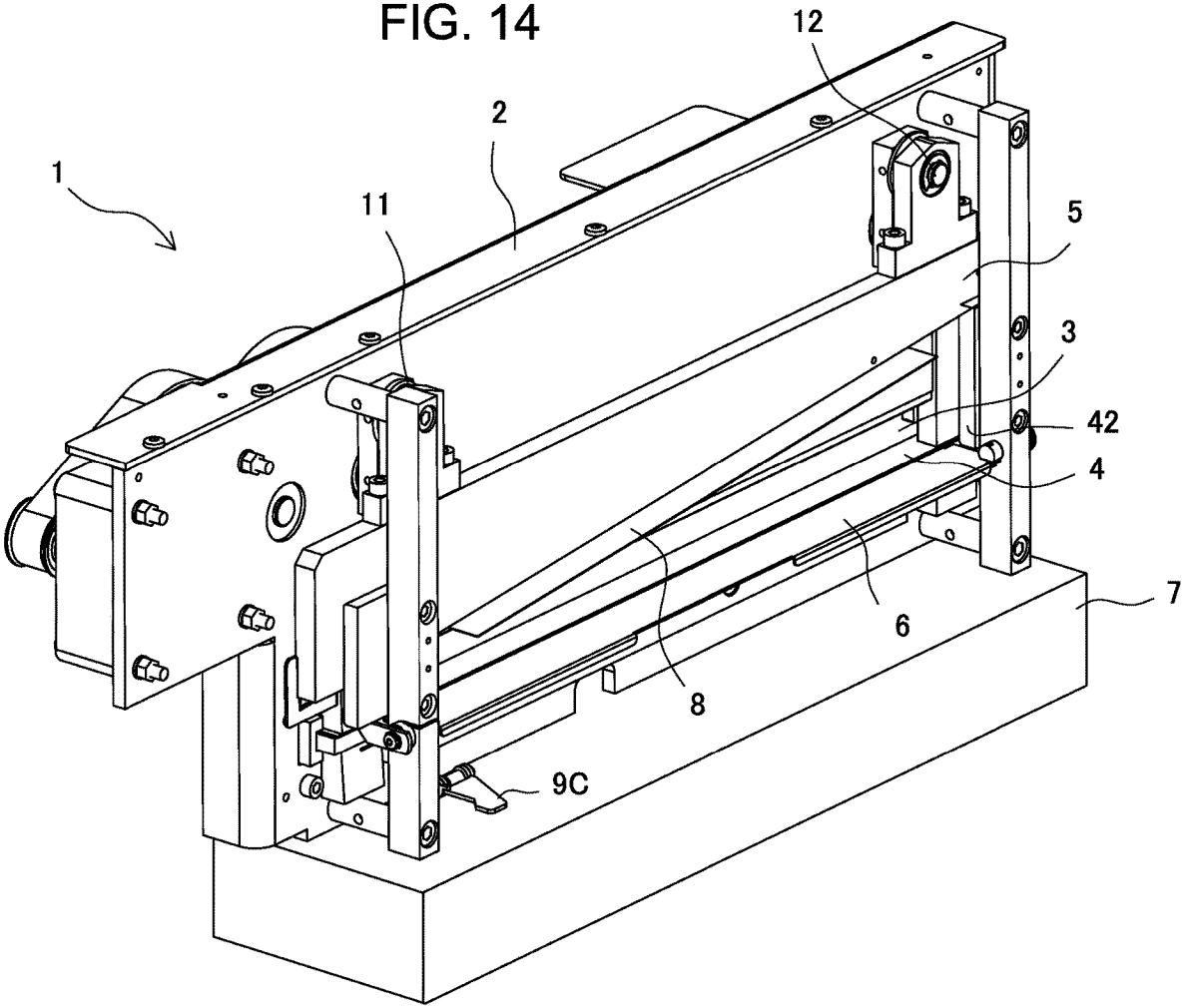
FIG. 14 is a perspective view of a sheet cutting device that includes a second support section having one L-shaped portion.
Figure 15A:
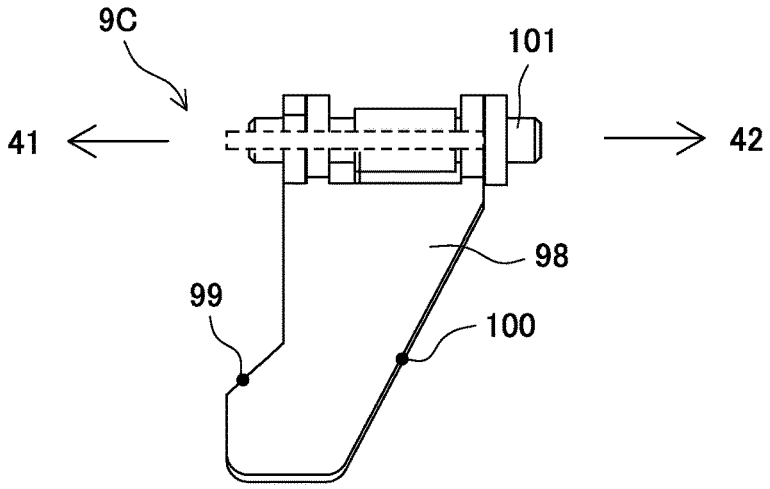
FIG. 15A is a plane view of the second support section of the sheet cutting device shown in FIG. 14 that has one L-shaped portion.
Figure 15B:
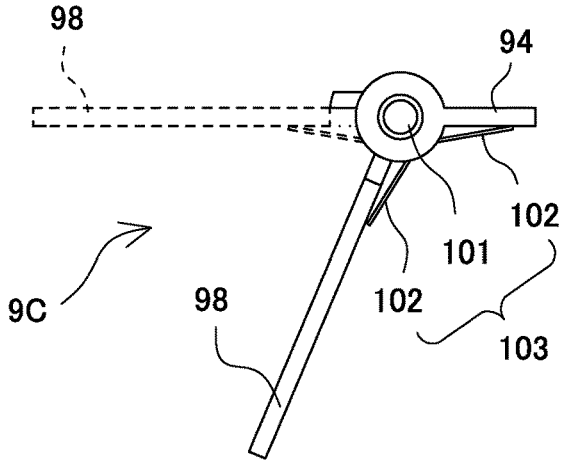
FIG. 15B is a side view of the second support section of the sheet cutting device shown in FIG. 14 that has one L-shaped portion.
Figure 15C:
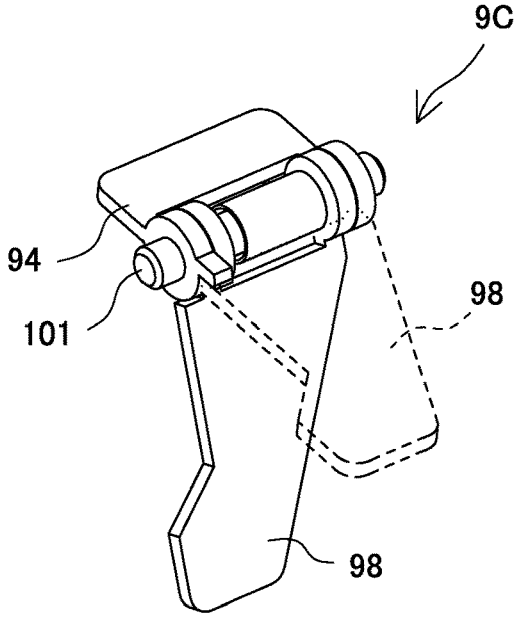
FIG. 15C is a perspective view of the second support section of the sheet cutting device shown in FIG. 14 that has one L-shaped portion.

Instead of the comb-like support section 9, the sheet cutting device 1 may have a second support section 9C having one L-shaped portion. FIG. 14 is a perspective view of the sheet cutting device 1 that includes the second support section 9C having one L-shaped portion. FIG. 15A is a plane view of the second support section 9C of the sheet cutting device 1 shown in FIG. 14 that has one L-shaped portion. FIG. 15B is a side view of the second support section 9C of the sheet cutting device 1 shown in FIG. 14 that has one L-shaped portion. FIG. 15C is a perspective view of the second support section 9C of the sheet cutting device 1 shown in FIG. 14 that has one L-shaped portion. In FIGS. 15B and 15C, the areas indicated by broken line represent an L-shaped section 98 (described later) that is in a substantially horizontal state.

As in the case of the support section 9B, the second support section 9C having one L-shaped portion includes an L-shaped section 98 and a fixed section 94. The L-shaped section 98 is a plate-like member. The L-shaped section 98 and the fixed section 94 are made of resin such as ABS resin, and are formed as one unit. The support section 9C further includes an attaching section 103, which includes a hinge 101 and a spring 102. As shown in FIGS. 14, 15A, 15B, and 15C, the hinge 101 is attached to the fixed section 94, and the spring 102 is attached to the vertically downward sides of the L-shaped section 98 and fixed section 94.

As in the case of the support section 9B, the fixed section 94 is attached to the bottom surface of the frame 2, which serves as a holding section, and the support section 9C is therefore mounted on the frame 2. At this time, in the case where the placement surface 31 of the stage 3 that is in a horizontal state faces the vertically upward side, the support section 9C is mounted on the frame 2 in such a way that the L-shaped section 98 is positioned horizontally and the spring 102 is located on a vertically downward side of the L-shaped section 98.

Figure 16:
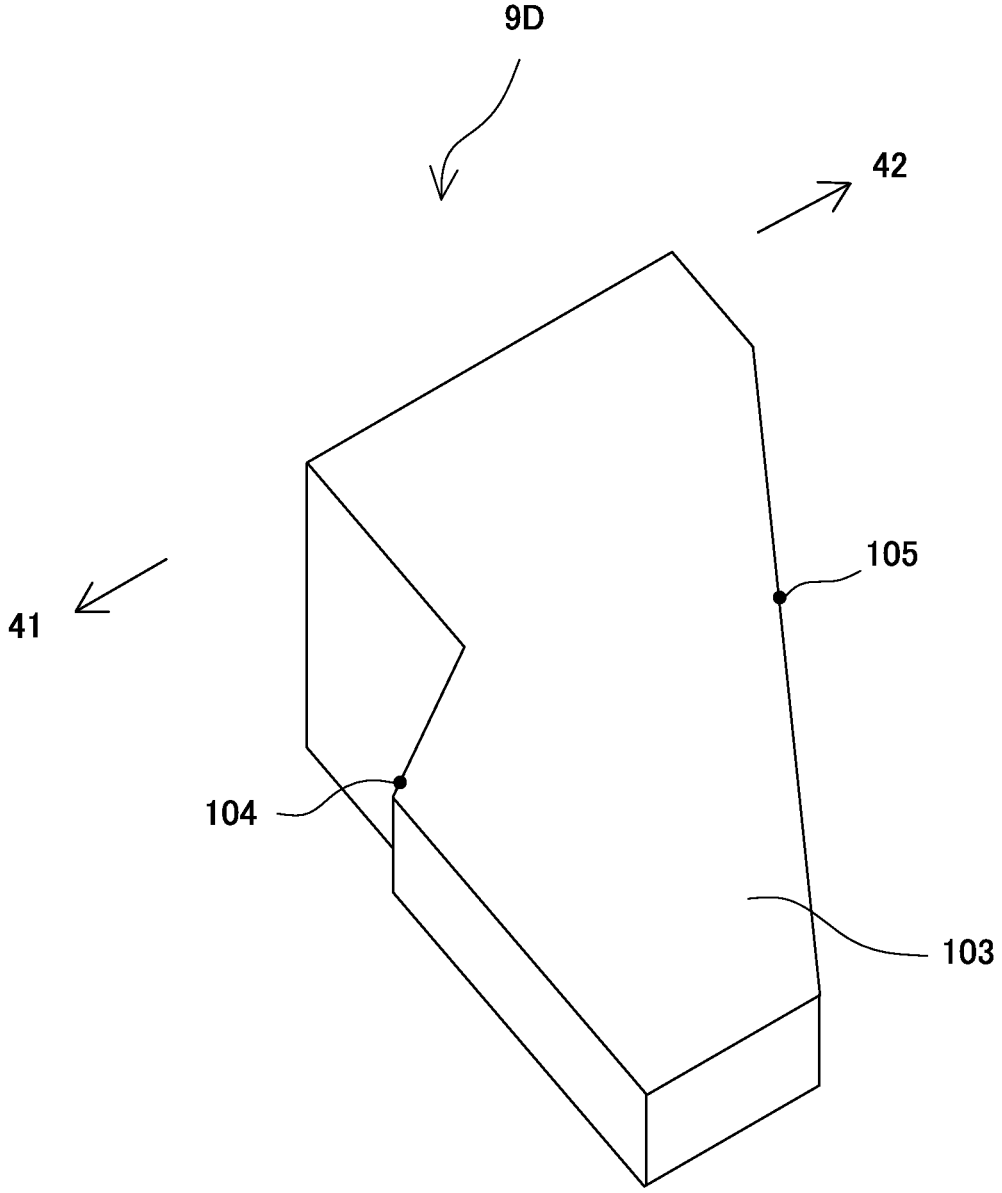
FIG. 16 is a perspective view of a lumpish support section.

The sheet cutting device 1 may include a lumpish support section 9D, instead of the comb-like support section 9. FIG. 16 is a perspective view of the lumpish support section 9D. An upper surface of the lumpish support section 9D is a flat surface, which is inclined vertically downward when the placement surface 31 of the stage 3 that is in a horizontal state faces the vertically upward side. Moreover, a portion 104 of a side portion of the lumpish support section 9D that is closer to the one side 41 of the fixed blade 4 is inclined toward the one end 41 of the fixed blade 4. More specifically, the portion 104 is bent, and is inclined toward a plane that contains the one end 41 of the fixed blade 4 and is perpendicular to the placement surface 31 of the stage 3 and to a plane that is part of an outer surface different from the placement surface 31 of the stage 3 and contains the one end 41 of the fixed blade 4 and the other end 42.

As described above, a side portion of the support section 9A, 9B, 9C, or 9D that is closer to the one end 41 of the fixed blade 4 is perpendicular to a plane that is part of an outer surface different from the placement surface 31 of the stage 3 and contains the one end 41 of the fixed blade 4 and the other end 42; or at least one portion of the side portion that is closer to the one end 41 of the fixed blade 4 is inclined to the one end 41 of the fixed blade 4. According to this configuration, the remnants W hanging after the remnants W are generated by the cutting are easily caught by the support section 9A, 9B, 9C, or 9D. That is, the support section 9A, 9B, 9C, or 9D can easily and temporarily support part of the remnants W hanging after the remnants W are generated by the cutting.

As described above, a side portion of the support section 9A, 9B, 9C, or 9D that is closer to the other end 42 of the fixed blade 4 is perpendicular to a plane that is part of an outer surface different from the placement surface 31 of the stage 3 and contains the one end 41 of the fixed blade 4 and the other end 42; or at least one portion of the side portion that is closer to the other end 42 of the fixed blade 4 is inclined to the one end 41 of the fixed blade 4. In this configuration, the support section 9A, 9B, 9C, or 9D temporarily supports the remnant W hanging after the remnant W is generated by the cutting, and allows the remnant W to easily slide vertically downward after the cutting is finished and then be stored in the waste box 7.

Furthermore, as described above, when a part of the support section 9A or 9C temporarily supports the remnant W hanging after the remnant W is generated by the cutting, the part of the support section 9A or 9C changes the posture from a horizontal state to the vertically downward side due to the weight of the remnant W in the case where the placement surface 31 of the stage 3 that is in a horizontal state faces the vertically upward side. The upper surface of the support section 9B or 9D is inclined vertically downward. In this configuration, the support section 9A, 9B, 9C, or 9D temporarily supports the remnant W hanging after the remnant W is generated by the cutting, and allows the remnant W to easily slide vertically downward after the cutting is finished and then be stored in the waste box 7.

Incidentally, the support section 9A is made of film. When the support section 9A temporarily supports the remnant W, the support section 9A changes the posture from a horizontal state to the vertically downward side due to the weight of the remnant W. After the remnant W falls into the waste box 7, the support section 9A restores the posture. Therefore, the support section 9A can continue functioning to temporarily support the remnant W hanging. The support section 9C includes the spring 102. Therefore, the support section 9C's function of restoring the posture after the remnant W falls into the waste box 7 continues working for a longer period than those of the support sections 9 and 9A.

The support sections are not limited to those described above. For example, a rod-shaped support section may be used.

In the above embodiment, when the placement surface 31 of the stage 3 that is in a horizontal state faces the vertically upward side, the support section 9 is located at a position that is closer to the vertically upward side than the top of the waste box 7, which is placed closer to the vertically downward side than the fixed blade 4. In this manner, in the above-described case, the support section is located closer to the vertically upward side than the bottom surface of the waste box 7. For example, the support section may be provided on an internal surface of the waste box 7.

The support section may be made of conductive material such as aluminum. In this case, even if the remnants W hanging after the remnant W is generated by the cutting, which is temporarily supported by the support section, is being electrically charged, the support section can remove electricity, making it easier for the remnant W to be stored in the waste box 7 after the cutting is finished.

In the above embodiment, the movable blade 5 is a plate-like blade. However, the movable blade 5 may not be a plate-like blade.

In the above embodiment, the sheet cutting device 1 comes after the image formation device. However, the sheet cutting device 1 of the present embodiment may not necessarily come after the image formation device. If the sheet cutting device 1 comes after the image formation device, the guide plate 6 guides a to-be-cut sheet S to the placement surface 31 of the stage 3. If the sheet cutting device 1 does not come after the image formation device, the guide plate 6 may not be used. However, the guide plate 6 also functions as an auxiliary section to supplementarily support portions of the to-be-cut sheets S protruding from the stage 3 after the sheets S are placed on the placement surface 31 of the stage 3. Therefore, if the sheet cutting device 1 does not come after the image formation device, what is used instead of the guide plate 6 is an auxiliary section that supplementarily supports portions of the to-be-cut sheets S protruding from the stage 3 after the sheets S are placed on the placement surface 31 of the stage 3.

The present invention is not limited to the above embodiments. The embodiments may be modified in various ways on the basis of the spirit of the present invention, and modified examples are not excluded from the technical scope of the present invention.

INDUSTRIAL APPLICABILITY

The present invention relates to a sheet cutting device that cuts sheets at the time of bookbinding, and therefore has industrial applicability.

Incidentally, the present application claims priorities from Japanese Patent Application No. 2013-152078 and Japanese Patent Application No. 2013-152079, the contents of which are incorporated herein by reference.

What is claimed is:

1. A sheet cutting device, comprising:

a stage that includes a substantially horizontal and vertically upward placement surface on which a to-be-cut sheet is placed;

a strip-shaped fixed blade that is provided in one end portion of the stage;

a movable blade that approaches the fixed blade gradually from one end of the fixed blade to another end of the fixed blade, and works together with the fixed blade to cut the sheet placed on the placement surface of the stage gradually from the one end of the fixed blade to the another end of the fixed blade while generating a remnant; and a support section that is located vertically lower than the fixed blade and vertically upper than a bottom surface of a waste box placed vertically lower than the fixed blade, between the one end of the fixed blade and the another end of the fixed blade, protrudes in a direction perpendicular to an outer surface of the stage adjacent to the placement surface of the stage, that contains the one end of the fixed blade and the another end of the fixed blade, and includes a first side portion that is close to the one end of the fixed blade and a second side portion that is close to the another end of the fixed blade, wherein the second side portion is inclined toward the one end of the fixed blade, to temporarily support a portion of the remnant generated after cutting by the fixed and movable blades.

2. The sheet cutting device according to claim 1, wherein the support section includes a flexible film member that changes posture between a support position where the support section takes a substantially horizontal posture to temporarily support the portion of the remnant, and a falling position where the support section takes a posture of being inclined vertically downwardly by a weight of the remnant to allow the remnant to fall into the waste box.

3. The sheet cutting device according to claim 2, wherein the support section includes a plurality of film members that are provided substantially horizontally.

4. The sheet cutting device according to claim 1, wherein the support section includes: a plate-like member; and an attaching section that elastically holds the plate-like member in such a way that the plate-like member freely moves between a support position where the plate-like member takes a substantially horizontal posture to support part of the remnant, and a falling position where the plate-like member takes a posture of being inclined vertically downward to allow the remnant to fall into the waste box.

5. The sheet cutting device according to claim 1, comprising:

an auxiliary section that supplementarily supports a portion of the sheet protruding from the stage after the sheet is placed on the placement surface of the stage; and a scraping-off section that moves from a vertically upward side to a vertically downward side to scrape off a remnant adhering to the auxiliary section after the remnant is generated by cutting by the fixed and movable blades.

6. The sheet cutting device according to claim 5, wherein the scraping-off section is fixed on a plane where the scraping-off section does not come in contact with the fixed blade of the movable blade.

7. The sheet cutting device according to claim 6, wherein the scraping-off section includes a plate-like scraping-off member that is provided substantially horizontally.

8. The sheet cutting device according to claim 7, wherein the scraping-off section is attached to the movable blade in such a way as to be able to swing.

9. The sheet cutting device according to claim 5, wherein the scraping-off section is conductive.

10. The sheet cutting device according to claim 5, wherein the scraping-off section is a brush.

11. The sheet cutting device according to claim 5, wherein the scraping-off section is made of cloth.

12. The sheet cutting device according to claim 5, wherein:

the auxiliary section has a function of guiding the sheet processed by an image formation device to the placement surface of the stage; and the scraping-off section is provided at a position where the scraping-off section does not come in contact with the sheet when the auxiliary section guides the sheet to the placement surface of the stage.

13. The sheet cutting device according to claim 9, wherein:

the auxiliary section has a function of guiding the sheet processed by an image formation device to the placement surface of the stage; and the scraping-off section is provided at a position where the scraping-off section comes in contact with the sheet when the auxiliary section guides the sheet to the placement surface of the stage.

14. The sheet cutting device according to claim 1, wherein the outer surface of the stage extends downwardly from the placement surface, and the support section is fixed to the outer surface of the stage and protrudes laterally outwardly from a lower portion of the outer surface of the stage.

15. The sheet cutting device according to claim 1, wherein the support section includes a flexible film member configured to change posture from a horizontal state to a vertically downward state, and to restore the posture from the vertically downward state to the horizontal state.

16. The sheet cutting device according to claim 15, wherein the support section has a comb-shape having a plurality of teeth, each of the teeth being arranged not to overlap vertically to each other, and to restore the posture from the vertically downward state to the horizontal state.

17. The sheet cutting device according to claim 1, further comprising:

a holding section for attaching the support section to the stage, wherein the support section further includes an attaching section having a hinge and an urging member, and a plate-shaped member that temporarily supports a portion of the remnant and is attached to the holding section through the attaching section such that the plate-shaped member is placed horizontally.

18. The sheet cutting device according to claim 1, wherein the support section is arranged closer to the one end than the another end of the fixed blade to temporarily support only one end portion of the remnant cut from the sheet until another end portion of the remnant to be cut is cut from the sheet by the fixed and movable blades.

19. The sheet cutting device according to claim 1, wherein the stage includes the placement surface of the stage, the outer surface of the stage being arranged perpendicular to the placement surface of the stage so that a length of the first side portion of the support section projecting from the outer surface is different from a length of the second side portion of the support section projecting from the outer surface.

* * * * *